US010227154B1

(12) United States Patent
Garrett et al.

(10) Patent No.: US 10,227,154 B1
(45) Date of Patent: Mar. 12, 2019

(54) MOVABLE LOADING SUPPORT PLATFORM WITHIN A CONTAINER

(71) Applicant: Amazon Technologies, Inc., Seattle, WA (US)

(72) Inventors: Samuel Gardner Garrett, Seattle, WA (US); Martin Peter Aalund, Seattle, WA (US); Vinay Balan, Seattle, WA (US); Michael Barrett Hill, Seattle, WA (US); David Bruce McCalib, Jr., Seattle, WA (US); Timothy Alan Talda, Seattle, WA (US); Toby Ge Xu, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 338 days.

(21) Appl. No.: 15/250,723

(22) Filed: Aug. 29, 2016

(51) Int. Cl.
*B65B 57/12* (2006.01)
*B65B 35/10* (2006.01)
*B65B 43/54* (2006.01)

(52) U.S. Cl.
CPC ..... *B65B 57/12* (2013.01); *B65B 35/10* (2013.01); *B65B 43/54* (2013.01)

(58) Field of Classification Search
CPC ..... B65B 57/12
USPC ..... 53/493
See application file for complete search history.

(56) References Cited

U.S. PATENT DOCUMENTS 5,165,218 A * 11/1992 Callahan, Jr. ..... B65B 5/06 53/243
2006/0025884 A1* 2/2006 Henkel ..... B65B 5/103 700/216
2009/0074545 A1* 3/2009 Lert, Jr. ..... B65G 1/0492 414/276

* cited by examiner

*Primary Examiner* — Lori Baker
(74) *Attorney, Agent, or Firm* — Baker & Hostetler LLP

(57) ABSTRACT

A moveable support platform within a container may reduce a distance that items fall into the container when stowed. The moveable support platform is lowered by a movement mechanism as items are placed into the container. The movement mechanism may be a bladder filled with air, a biasing device, a pneumatic device, or a mechanical device. The moveable support platform may form a bottom portion of the container during transport of the container. In some instances, the movement mechanism may lift items out of the container to empty the container at a destination.

20 Claims, 11 Drawing Sheets

MOVABLE LOADING SUPPORT PLATFORM WITHIN A CONTAINER

BACKGROUND

Containers are constantly packed and unpacked in fulfillment centers that manage movement and storage of items sold on electronic marketplaces. In modern fulfillment centers, automation is heavily used and items are often sorted and moved to different locations by item conveyers. However, containers, such as reusable totes or cardboard shipping boxes, are often loaded with items manually by a human worker. The worker is responsible for packing the container in a way that prevents damage to items during the packing, but also during the transit of the items in the container. Packing containers manually by workers requires extra time for handling of each item and is expensive.

Some item conveyers transport items directly into containers. In these arrangements, the items typically fall to the bottom of the container and may be damaged by the fall or by an impact from above by a heavy item deposited into the container. For example, when a light bulb is followed by a dictionary along the item conveyer that feeds items into the container, the light bulb would likely get crushed when the dictionary falls on top of the light bulb. One solution is to order the heavier items first along the item conveyer. However, this sortation is often logistically challenging and expensive. For example, additional sortation may require additional conveyers and/or other hardware or sensors.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1A:
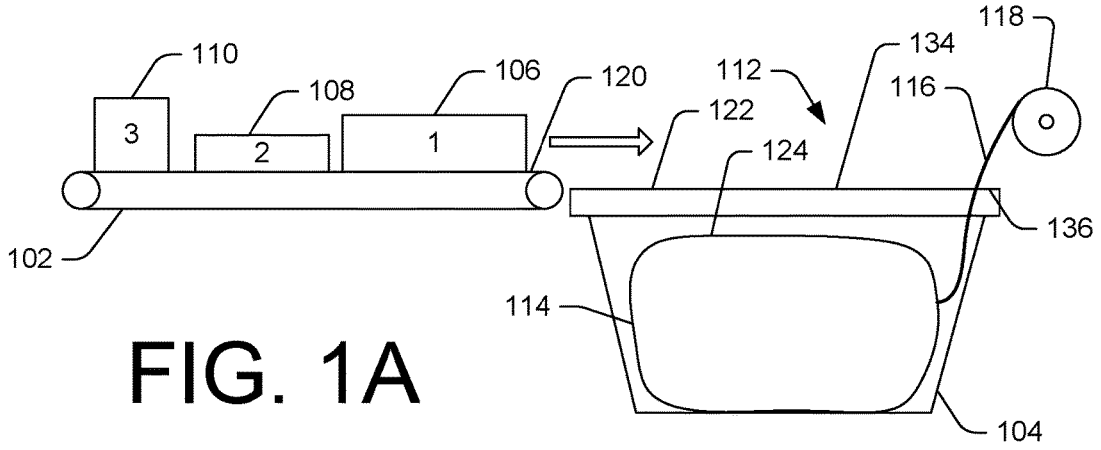
FIGS. 1A-1C show schematic diagrams of an illustrative packaging bladder that selectively is inflated or deflated to reduce a distance an item falls when conveyed into a container.

This disclosure is directed to techniques, systems, and apparatuses for loading and unloading containers with items using automation that requires little or no human interaction. In some embodiments, a space-filling device, such as an inflatable bladder (e.g., balloon, airbag, etc.), is used to prevent or minimize a distance of a fall of an item entering a container. The bladder is deflated as items are loaded into the container until the bladder is empty and the container is full of items. By deflating the bladder as items are loaded into the container, a heavier item may be safely placed on a relatively fragile item since the heavier item will not experience a considerable fall (e.g., the bladder reduces the potential energy of a dictionary since the dictionary has a shorter fall into the container than would otherwise occur if the bladder was not present in the container). In addition, the bladder may act as a dampener to absorb an impact force caused by a falling object, and thus further reduce a likelihood of damage to items falling into the container or items below the falling items. Although the terms "fall" and "falling" are used, this is not limited to a freefall of an item. Instead, items may slide from an item conveyer into a contain, but then drop at least some distance downward into the container, possibly while sliding along a surface of the bladder or another surface or rotating about an edge that contacts another surface. The inflatable container may be used with existing containers, and thus may not require custom containers to be used with the bladder. However, some embodiments described below include customized containers. The bladder, when deflated, may be shipped with the container full of items or may be removed from the container prior to shipment of the container and items.

In various embodiments, a support platform (e.g., surface, base, or member) may be used with the container and may be selectively raised and lowered within the container to minimize a distance of a fall of an item deposited into the container. The support platform may be lowered as items are loaded into the container until the support platform reaches a bottom position proximate to the bottom of the container. The support platform may be raised and lowered by pneumatic devices, mechanical devices, and/or other controlled devices.

The embodiments described above may also be used to unload items from a container. For example, when the bladder is shipped with the container full of items, and the bladder is under the items, the bladder may be re-inflated to cause the items in the container to be pushed out of the container, possibly onto another item conveyer that moves the items away from the container without human interaction. Similarly, the support platform may be moved upward to empty items from the container.

In accordance with one or more embodiments, an item sortation apparatus may be used to selectively deposit heavier items into a container while lighter items traverse past a "trapdoor" to a holding area for later deposit on top of or around the heavier items in the container. The trapdoor may act as a sorting mechanism that sorts items based on weight and/or other attributes of items. The trapdoor may be held in place by at least one of a biasing device, an electromagnetic force, a counter weight, a mechanical arm, a pneumatic force, and/or by other forces that can be overcome by a heavier object by not by a lighter object. A weight of an item that causes the trapdoor to open may be a design consideration, and thus may depend on the application of use of such a device.

As discussed herein, a container may be any instrument to secure items for transport and/or storage, such as a bag, a cardboard box, or a reusable tote, among many other possible examples. The apparatuses, techniques, and systems described herein may be implemented in a number of ways. Example implementations are provided below with reference to the following figures.

Figure 1B:
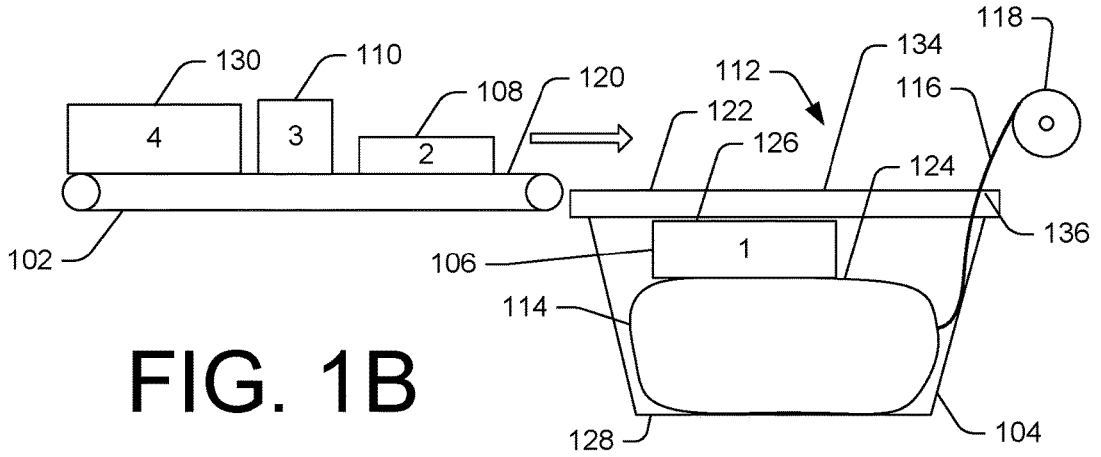
Figure 1C:
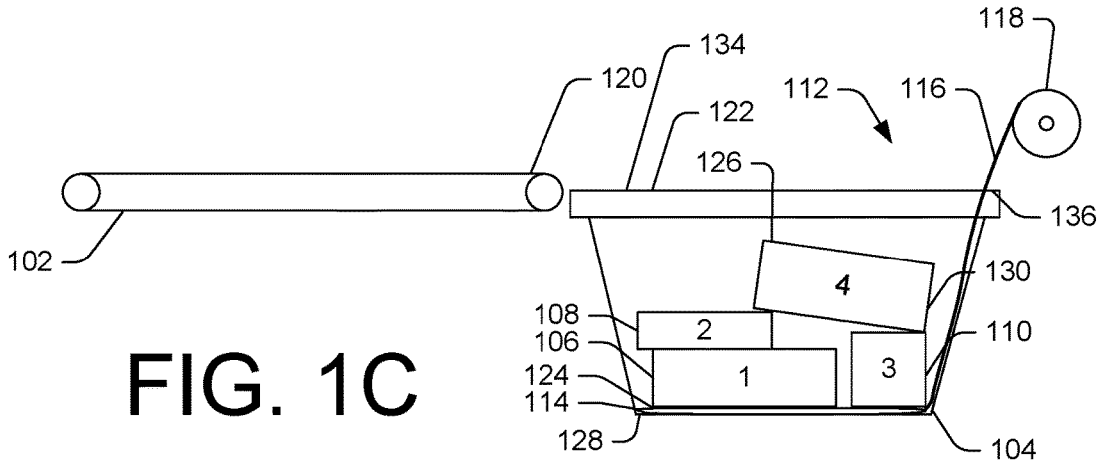

FIGS. 1A-1C show schematic diagrams of an illustrative packaging bladder that selectively is inflated or deflated to reduce a distance an item falls when conveyed into a container. As shown in FIG. 1A, an item conveyer 102 may transport or convey items toward a container 104. The item conveyer 102, and other conveyers described herein may be driven rollers, free-spinning rollers, belts, slides, chutes, and/or other types of item conveyance mechanisms typically used in warehouses to move products with little or no human interaction. The container 104 may have a top side that is open, and capable to receive items pushed into the container 104 by the item conveyer 102. The top side that is open may be referred to as an opening 134 of the container 104 and the top edge of the opening 134 may be referred to as a rim 136. The rim 136 may extend, either partly or fully, around the perimeter of the opening 134. The container 104 may be a tote, a cardboard box, a bag, and/or any other type of container. The items may include a first item 106, a second item 108, and a third item 110. However, more or fewer items may be loaded into the container 104. For explanation purposes, the second item 108 may be relatively heavy than a first item while the first item 106 may contain a relatively fragile item compared to the second item, which may not be fragile. The items may be different and may be selected for placement on the item conveyer 102 for reasons other than weight or fragility concerns. The items may be unpackaged, packaged in retail packaging, or otherwise include some packaging or cushioning material in some instances. The first item 106 may be deposited first in by the item conveyer 102 into the container 104, followed in turn by the second item 108, the third item 110, and then possibly by other items until the container is full or ready for shipment.

An inflatable bladder system 112 may be used with the container 104 to decrease a distance that the items fall when entering the container 104. The inflatable bladder system 112 may include a bladder 114, a hose 116, and a bladder movement mechanism 118. The hose 116 may be coupled to the bladder 114 and the bladder movement mechanism 118, when implemented as an air supply controller, may be used to provide air to inflate the bladder 114 or exhaust air from the bladder 114 to deflate the bladder 114. The bladder movement mechanism 118 may be implemented as a spool that winds the hose to retrieve the bladder or unwinds the hose to deposit the bladder 114 into the container 104. However, the bladder movement mechanism 118 may be implemented using other mechanisms that cause movement of the bladder 114, such as a mechanical arm. The bladder may be a balloon, an air bag, and/or any other receptacle that expands with addition of air or any other gas. The bladder may be flexible and bendable, which may enable removal of the bladder from the container 104, as described below.

FIG. 1A shows the container 104 and inflatable bladder system 112 prepared for receipt of items, but before items are placed in the container by the item conveyer 102. As shown, a conveyer upper surface 120, which defines a conveyance height of the item conveyer 102, is situated slightly above a container upper surface 122 of the container 104 to enable items to fall from the item conveyer 102 into the container 104. Meanwhile, the bladder 114 includes a bladder upper surface 124 that is situated just below the container upper surface 122 to minimize the fall of the first item 106 entering the container 104 from the item conveyer 102. The location of the bladder upper surface 124 is controllable based on an inflation of the bladder 114, via the hose 116. For example, the hose 116 may be in fluid communication with an air compressor or other pneumatic air sources that provides air to the bladder 114 to inflate the bladder 114. The hose 116 or a release valve may be used to release air from the bladder 114, and thus lower a location of the bladder upper surface 122 relative to the container upper surface 122 as explained below. Various devices and controls for releasing air from the bladder are discussed with reference to FIGS. 3A-3C.

FIG. 1B shows the first item 106 deposited into the container 104 and supported by the bladder 114 such that an upmost item upper surface 126 is below the container upper surface 122. Meanwhile, the bladder 114 has been deflated, thereby lowering the upper bladder surface 122 to a position closer to a bottom 128 of the container 104. Air may be removed from the bladder after the deposit of the first item 106 into the container 104. The air may be removed based at least in part on the weight of the first item 106 pressing downward against the bladder 114. However, as discussed below, other mechanisms and/or controls may be used to control a release of air from the bladder, and thus lower the position of the upmost item upper surface 126 (which is associated with the upmost item, which is the first item 106 in FIG. 1B). Meanwhile a fourth item 130 may enter the item conveyer 102 for eventual deposit into the container 104.

FIG. 1C shows all of the items deposited into the container 104. The bladder 114 is deflated or substantially deflated such that an upmost item upper surface 126 (now associated with the fourth item 130 as shown in FIG. 1C) is below the container upper surface 122. Meanwhile, the bladder 114 has been deflated, thereby lowering the upper bladder surface 122 to a position closer to or proximate to the bottom 128 of the container 104. Air may be removed from the bladder after the deposit of some items or each item into the container 104. The container 104 may be ready for shipment, and may include at least the four items in this example, but possibly more or fewer items. As items are placed into, or "fall" into the container, the distance of the fall of each item is less than a distance would be if the bladder 114 was not present. This reduction in distance due to presence of the bladder 114 may prevent or minimize damage to items caused by the fall of the items into the container from the conveyer upper surface 120 toward the bottom 128 of the container 104. In some embodiments, the bladder 114 may be shipped with the items in the container 104, whether in an inflated state, a deflated state, or some intermediate state of inflation. For example, the hose 116 may be disconnected from the bladder 114 and/or from the bladder movement mechanism 118, or the hose 116 may possibly be cut, such as when the bladder is intended for limited use (e.g., one time use, etc.).

Figure 2A:
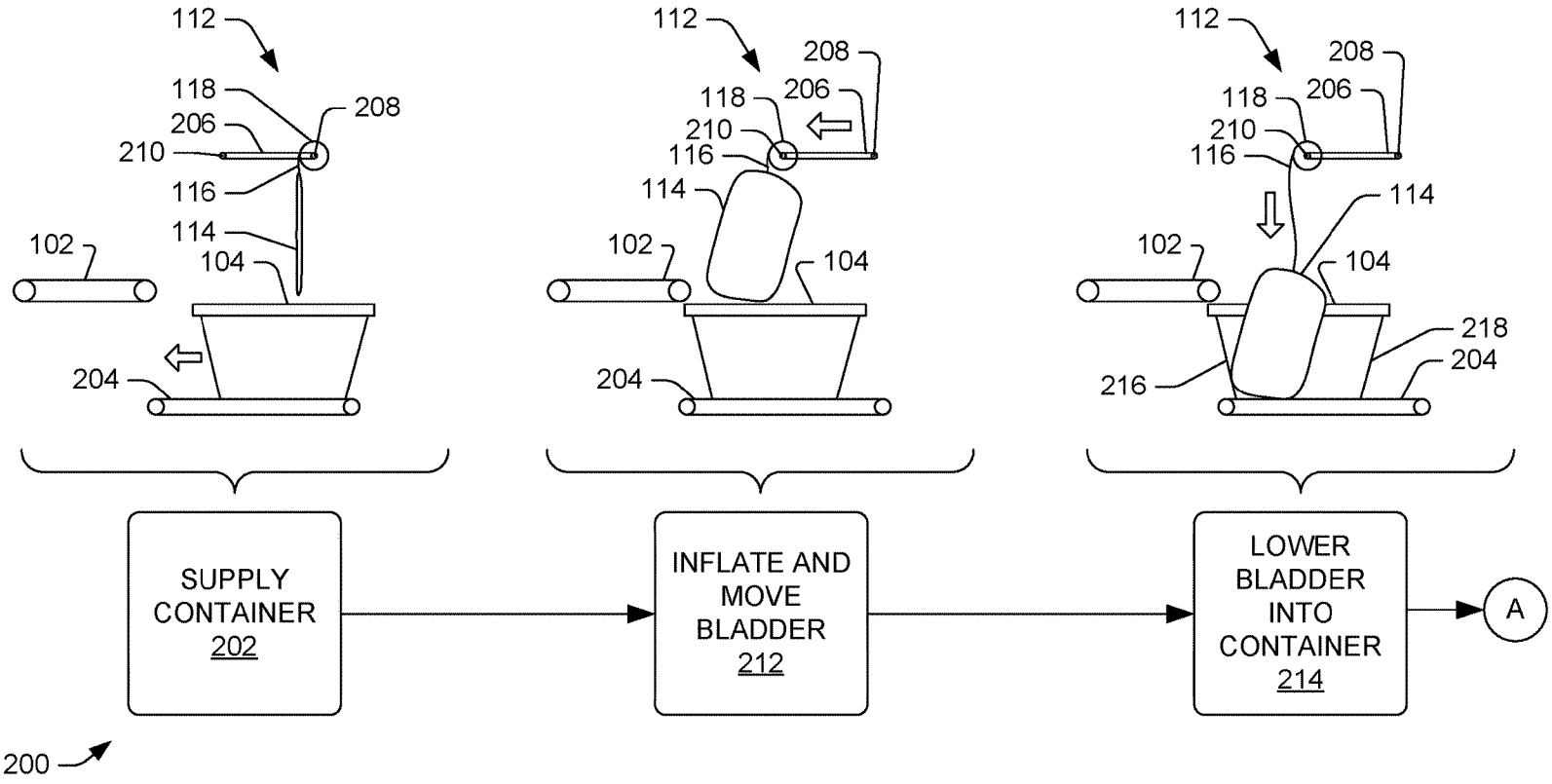
FIGS. 2A and 2B show a pictorial flow diagram of an illustrative process showing placement of the bladder in the container before items are placed in the container and removal of the bladder from the container after items are placed in the container, and some intermediary operations.
Figure 2B:
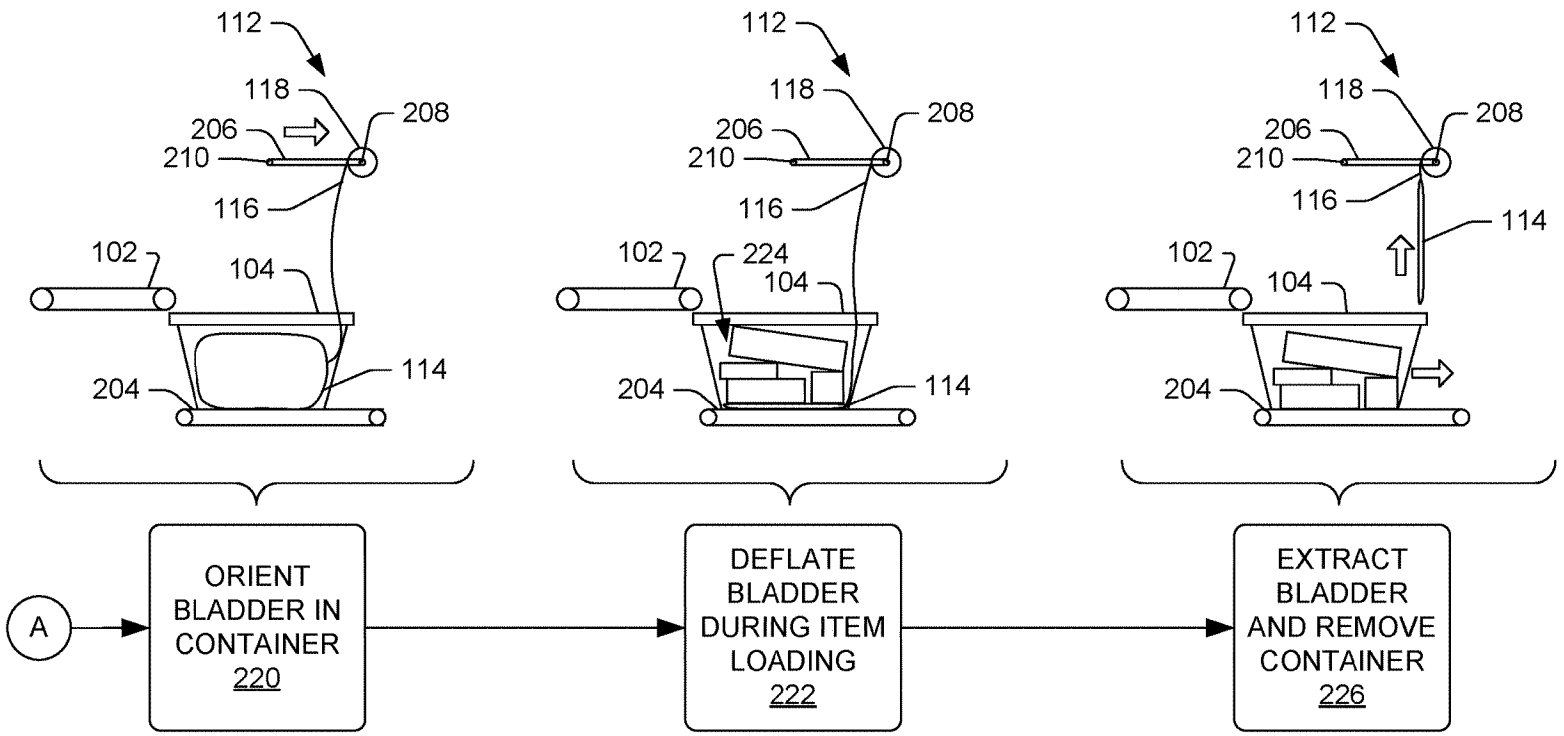

FIGS. 2A and 2B show a pictorial flow diagram of an illustrative process 200 showing placement of the bladder 114 in the container 104 before items are placed in the container and removal of the bladder 114 from the container 104 after items are placed in the container, and some intermediary operations.

As shown in FIG. 2A, at 202, the container 104, which may be empty, is supplied by a container conveyer 204 to a location proximate to and under the inflatable bladder system 112 and proximate to the item conveyer 102 that moves items into the container 104. The container may be readied to receive items from the item conveyer 102. The bladder 114 may be suspended above the container 104 as the container is moved to the location proximate to the item conveyer 102. The bladder movement mechanism 118 may traverse along a mechanism conveyer 206 between a first location 208 and a second location 210. At the operation 202, the bladder movement mechanism 118 may be located at the first location 208.

At 212, the bladder 114 may be inflated with air and moved, via the mechanism conveyer 206, to the second location 210. The bladder 114 may be inflated during the supplying of the container 104 at the operation 202 or after the container 104 is located at the location proximate to the item conveyer 102.

At 214, the bladder 114 may be lowered into the container 104. For example the hose 116 may be retracted or unspooled from the bladder movement mechanism 118 to cause the bladder 114 to be lowered into the container 104. The bladder 104 may be situated on a second side 216 of the container at is opposite a first side 218 of the container 104. The first side 218 of the container 104 may be generally under the first location 208 of the mechanism conveyer 206 while the second side 216 of the container 104 may be generally under the second location 210 of the mechanism conveyer 206. Since the hose 116 may connect to a side of the bladder 114, the bladder 114 may be lowered into the container in a vertical orientation, whereas the bladder 114 is used in a vertical configuration during loading of items into the container 104. In some embodiments, the container 104, the bladder 114, or both may include alignment mechanisms to cause the bladder 114 to be situated in a predetermined location and orientation with respect to the container 104. For example, the alignment mechanisms may be complementary magnets or electromagnets that cause the bladder 114 to be situated in the predetermined location and orientation in the container 104. As another example, the alignment mechanisms may include a shape of the bladder 114 and/or the walls and base of the container 104, which may guide a location of the bladder during at least the operation 214.

Turning to FIG. 2B, at 220, the bladder movement mechanism 118 may retract an additional amount of the hose 114 and the bladder movement mechanism 118 may traverse back to the first location 208 of the mechanism conveyer 206, causing the bladder 114 to transition from the vertical orientation shown with respect to the operation 214 to a horizontal orientation. Again, the alignment mechanisms may cause the bladder 114 to be situated in a predetermined location and orientation with respect to the container 104 while the bladder 114 is transitioned to the horizontal orientation.

In some embodiments, the bladder movement mechanism 118 may be omitted and the process 200 may instead rely on movement of the container 104 via the container conveyer 204 to achieve similar results shown and described with respect to operations 212 and 214 in FIG. 2A.

At 222, the bladder 114 may be used to reduce a fall of items 224 being deposited into the container 104 as discussed above with reference to FIGS. 1A-1C. The bladder 114 may be compressed and return to a deflated state.

At 226, the bladder movement mechanism 118 may lift the bladder 114 from the container 104 by taking up the hose 116. For example, the bladder movement mechanism 118 may wind the hose 116 (or another tether) about a spool to take up the hose 116 (or other tether) and thereby lift the bladder 114 from the container 104. The container, now loaded with the items 224, may be moved away from the inflatable bladder system 112 for further processing, such as for shipment to a different location. In some embodiments, another tether may be used to move (e.g., raise, lower, etc.) the bladder 114 other than the hose 116, such as to prevent damage to the hose 116. For example, a cable or line may be coupled to the bladder and the bladder movement mechanism 118 for such purposes. The cable or the line may or may not be coupled to the hose 116.

In some embodiments, the bladder 114 may be inflated after being placed in the container 104. For example, the bladder 114 may be formed such that it rolls up when deflated and not loaded with items on top of the bladder. The rolled up and deflated bladder may be placed in the container 104 as described above, and then inflated in the container to unroll and cover the bottom of the container or a portion of the bottom of the container.

Figure 3A:
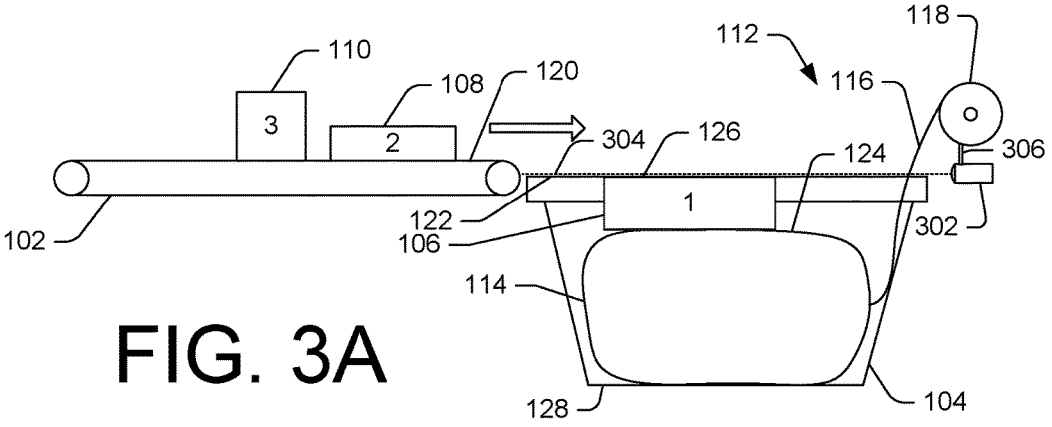
FIGS. 3A-3C are schematic diagrams of illustrative air supply controllers and/or devices used to control at least a rate or amount of deflation of the bladder for a given period of time.
Figure 3B:
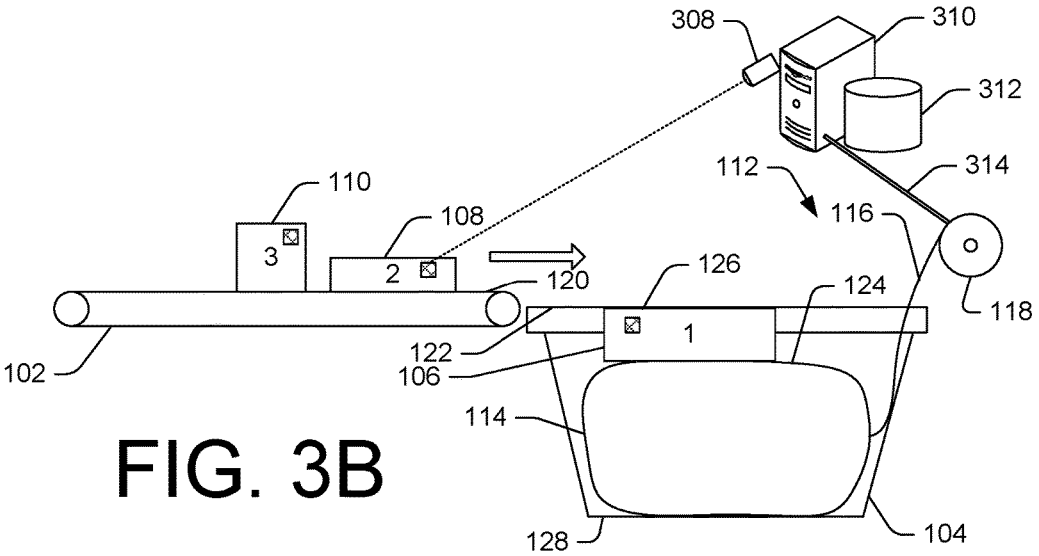
Figure 3C:
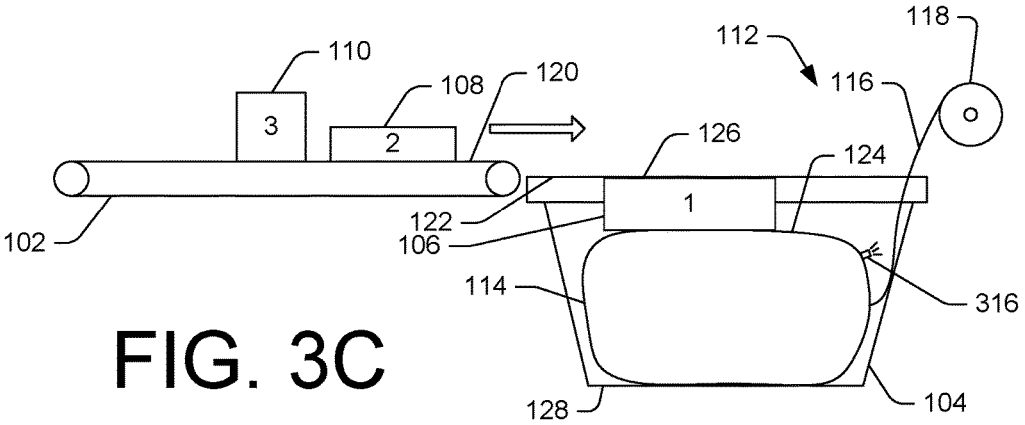

FIGS. 3A-3C are schematic diagrams of illustrative air supply controllers and/or devices used to control at least a rate or amount of deflation of the bladder for a given period of time.

FIG. 3A shows an optical sensor 302 directed along or aimed along a plane defined by or parallel to the container upper surface 122 of the container 104 such that the optical sensor 302 is capable of detecting an item protruding above the container upper surface 122 and braking or interfering with a fill line 304 while the item is locating in the container 104. When the optical sensor 302 detects an absence or interruption of light (e.g. reflection of light output from the optical sensor's light source, or light from a separate light source), the optical sensor may determine that the fill line 304 is blocked by the item. The optical sensor 302 may then transmit a signal to the inflatable bladder system 112 via a connection 306 to cause deflation of the bladder 114 until the fill line is unobstructed and light is again sensed by the optical sensor 302, and thus the item is below the fill line 304. The optical sensor 302 may be located at virtually any position or angle that creates the fill line 304 usable to control deflation of the bladder 114. The optical sensor 302 may include a light source or may rely on another independent light source to establish the fill line 302. The bladder 114 may be deflated by pumping air from the bladder 114 or opening a release valve to release air from the bladder 114, for example. The system described may be operated with or without a computing device executing software. For example, the system may be implemented as an electronic control switch that operates without software.

FIG. 3B shows an image sensor 308 directed toward the item conveyer 102 to detect presence of an item and to read a code, such as a barcode or other unique identifier of the item, from the item. The image sensor 308 may transmit the code to a computing device 310 for processing. The computing device 310 may access a data store 312 that includes item information, such as item physical dimensions, item volume, item weight, item fragility, and/or other physical properties of items. The computing device 314 may provide input to the inflatable bladder system 112 via a connection 314 to cause deflation of the bladder 114 an amount based on the item physical dimensions and/or other information about the item. The bladder 114 may be deflated by pumping air from the bladder 114, opening a release valve to release air from the bladder 114, for example. As an example operation, the computing device 310 may determine a next item has a certain height or volume based on capturing and processing the code. The computing device 310 may the cause the inflatable bladder system 112 to reduce a volume of the bladder 114 a corresponding amount such that the item is situated below the container upper surface 122 prior to arrival of a next item into the container 104. The process may be repeated for each item. Thus, the computing device 310 may actively control deflation of the bladder 114 based on identification of items about to be deposited into the container and based on attributes of those items. The volume of air removed from the bladder 114 may be different than a volume of the item. The computing devices is described in further detail with reference to FIG. 9.

FIG. 3C shows the bladder 114 with an exhaust valve 316, which also may be referred to herein as an air supply controller 316. The exhaust valve 316 may be configured to release air from the bladder at a predetermined rate and/or in response to downward pressure of items placed on top of the bladder 114. For example, the bladder 114 may include an internal air pressure, which may cause air to be forced through the exhaust valve 316 over time. In such embodiments, the bladder 114 may be formed of an elastic material, such as latex or rubber, which enables expansion of the bladder 114 under pressure. However, the bladder 114 may operate in some embodiments without internal air pressure, and thus may deflate when items are placed on top of the bladder 114. In various embodiments, the exhaust valve 316 may release air from the bladder 114 at least partly due to air pressure within the bladder 114 and at least partly from air pressure generated from an item placed on top of the bladder 114. The air pressure of the bladder and/or the exhaust rate of the exhaust valve may be selected to cause the bladder to deflate at a controlled and known rate, and thus operate to perform the functionality described above, with particular reference to FIGS. 1A-1C.

Figure 4A:
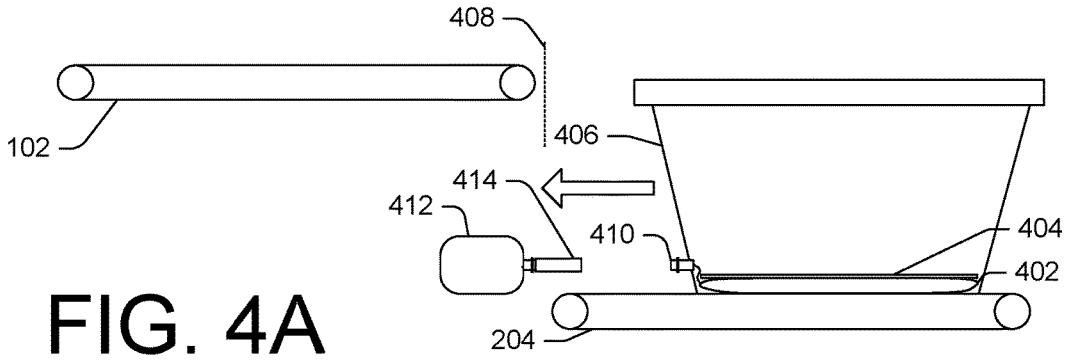
FIGS. 4A-4D show schematic diagrams of an illustrative container bladder that is selectively inflated or deflated to change a height of a support platform in the container to reduce a distance an item falls when conveyed into a container at a filling location.

FIGS. 4A-4D show schematic diagrams of an illustrative container bladder 402 (also referred to herein as a platform movement mechanism 402) that is selectively inflated or deflated to change a height of a support platform 404 in a container 406 to reduce a distance an item falls when conveyed into the container 406 at a filling location 408 (denoted in FIG. 4A as a dashed line that indicates a position of a leading edge of the container 406 with respect to the item conveyer 102 or other apparatuses. The support platform 404 may include a surface to interface with at least a first item deposited into the container. The support platform 404 may be a rigid planar object, for example.

FIG. 4A shows the container 406 being moved to the filling location 408. The filling location 408 is a location where the container 406 is proximate to the item conveyer 102 such that items can be conveyed directly into the container 406 via the item conveyer 102. The container 406 may include a container valve coupler 410 that can be coupled to an air supply 412 (e.g., a compressor or other source of air), via an air supply valve coupler 414 when the container 406 is located at the filling location 408. For example, the container conveyer 204 may move the container 406 (in an uncoupled state and with the bladder 402 deflated) toward the filling location 408. As the container 406 approaches the filling location 408, the container valve coupler 410 may mate/couple with the air supply valve coupler 414 to provide fluid communication between the air supply 412 and the bladder 402, and thus enable inflating the bladder 402. The mating/coupling may be performed using guides or other alignment devices that cause the mating of the container valve coupler 410 with the air supply valve coupler 414. For example, the guides may include a cone shape that projects from around the container valve coupler 410 (or from around the air supply valve coupler 414) and guides the complementary part for alignment during the coupling (e.g., similar to a refueling probe used by military aircraft for inflight refueling).

Meanwhile, the support platform 404 may be situated above or on an upper surface or area of the bladder 402. In some embodiments, the support platform 404 may be movably coupled to the container 406, such as by a track, to cause the support platform 404 to maintain an orientation with respect to the container during movement and/or for other reasons, such as to assist with removing items from the container, as discussed below with reference to FIGS. 5A-5D.

Figure 4B:
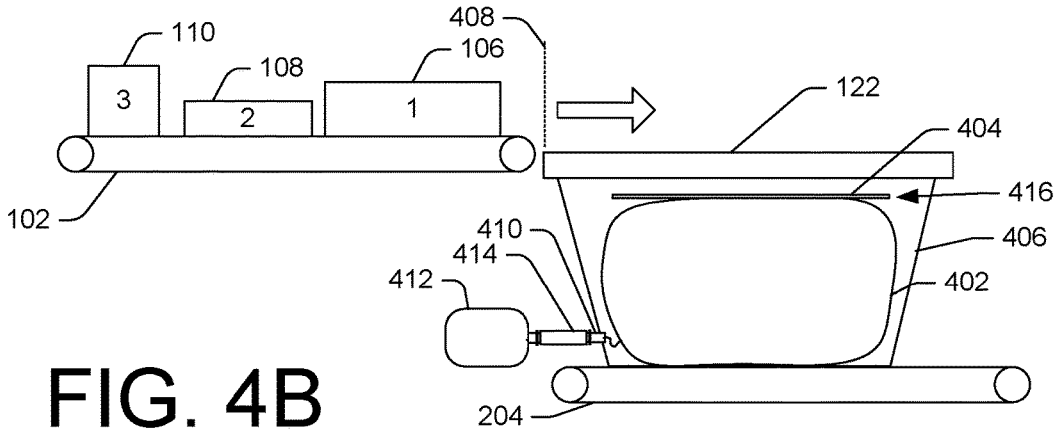

FIG. 4B shows the container 406 at the filling location 408 (where the leading edge of the container 406 is at the filling location 408). In some instances, the filling location 408 may include a trigger switch that is activated when the container 406 is at the filling location 408 (e.g., by physical contact, etc.). The trigger switch, when activated, may enable the item conveyer 102 to operate to move items into the container 406.

At the filling location 408, the container valve coupler 410 is coupled to the air supply 412 via the air supply valve coupler 414. After the coupling of the container valve coupler 410 to the air supply valve coupler 414, the air supply 412 may provide air to the bladder 402 to inflate the bladder 402 and thereby raise the support platform 404 to a predetermined location 416 to receive the first item 106 from the item conveyer 102. The predetermined location 416 may be below the container upper surface 122.

Figure 4C:
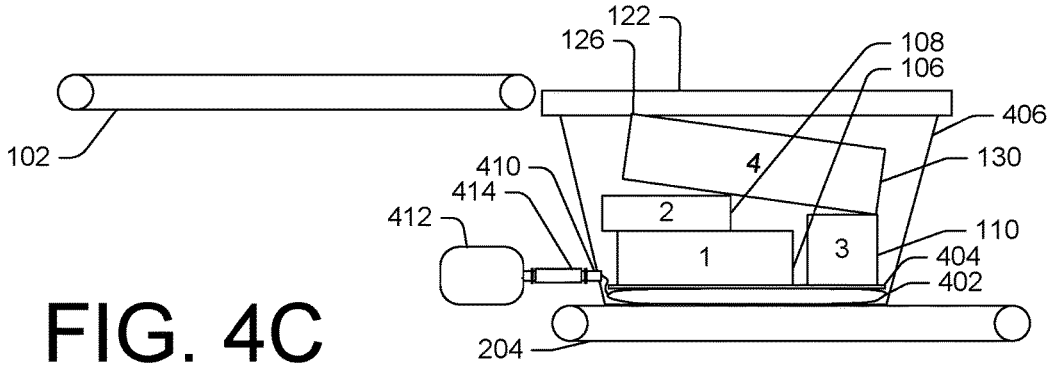

FIG. 4C shows the container 406 after being filled with items. During the filling of the container 406, the support platform 404 may be lowered such that a next item deposited into the container 406 falls into the container 406, and yet maintains the upmost item upper surface 126 at a location near, but below, the container upper surface 122. The depositing of the items may be performed as described above with reference FIGS. 1A-1C, 2, and 3A-3C describing operation of the bladder 114 and associated components, such as the optical sensor 302, the exhaust valve 316, and so forth. In some embodiments, the air supply 412 may recapture air from the bladder 402 to cause the bladder 402 to deflate, and thereby lower the level of the support platform 404.

Figure 4D:
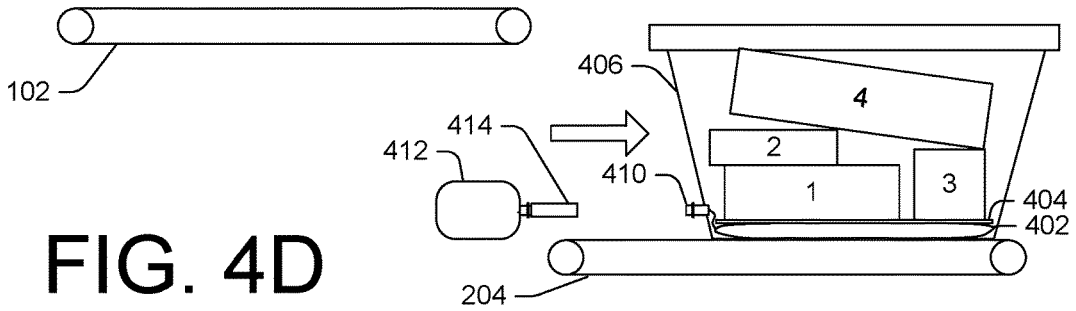

FIG. 4D shows the container 406 full of items after moving away, via the container conveyer 204, from the filling location 408. When employed, the trigger switch may be deactivated when the container is moved away from the filling location 408, which may cause the item conveyer 102 to stop. The container valve coupler 410 is decoupled from the air supply valve coupler 414, and thus from the air supply 412. After the decoupling, the bladder 402 may deflate to exhaust air. In some embodiments, the container valve coupler 410 may include a dust cover to prevent dust or other particulates from entering the bladder 402 during shipping, handling, and/or storage of the container 406. The dust cover may open during the coupling of the container valve coupler 410 to the air supply valve coupler 414 to allow airflow through the container valve coupler 410. The container 406, the bladder 402 and the support platform 404 may be shipped with the items to a destination. The embodiments described with reference to FIGS. 4A-4D may be used with any of the prior embodiments described, such as the embodiments described with reference to FIGS. 3A-3C.

FIGS. 5A-5D show schematic diagrams of the illustrative bladder 402 (also referred to herein as the platform movement mechansim 402) that is selectively inflated or deflated to change a height of the support platform 404 in the container 406 to empty items from the container 406 at a destination location 502.

Figure 5A:
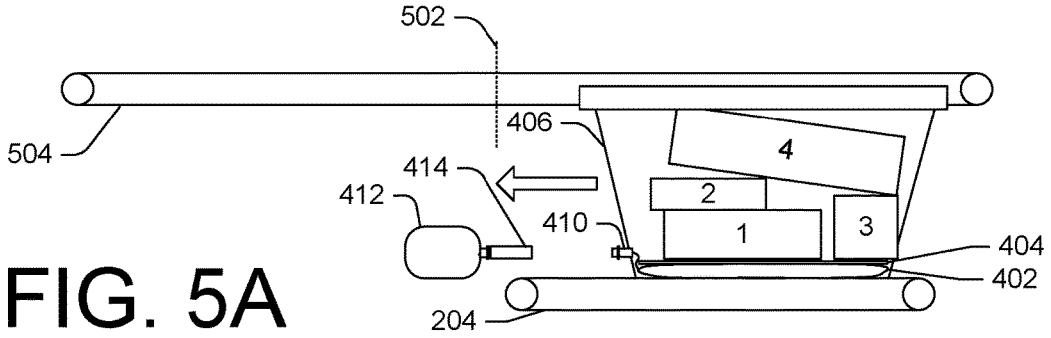
FIGS. 5A-5D show schematic diagrams of the illustrative container bladder that is selectively inflated or deflated to change a height of the support platform in the container to empty items from the container at a second location.

FIG. 5A shows the container 406, filled with the items, being moved toward the destination location 502 (shown as a dashed line) where the items in the container will be unloaded from the container 406 and placed upon a receiving conveyer 504.

Figure 5B:
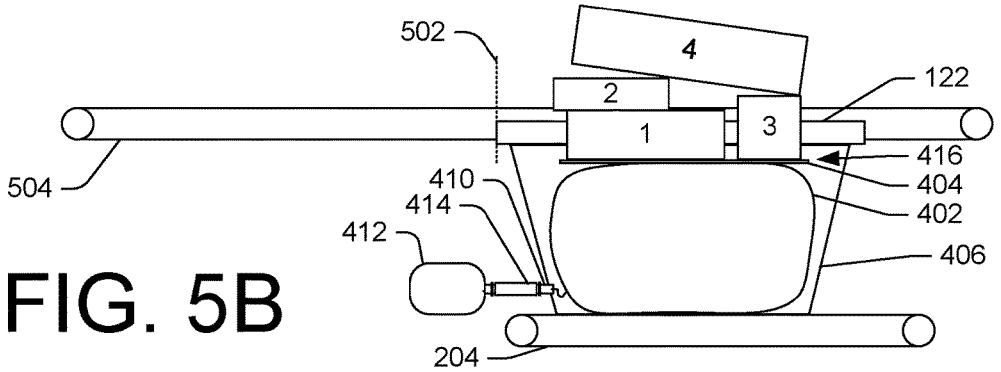

FIG. 5B shows the container 406 at the destination location 502, where the leading edge of the container 406 is at the destination location 502. In some instances, the destination location 502 may include a trigger switch that is activated when the container 406 is at the destination location 502 (e.g., by physical contact, etc.). The trigger switch, when activated, may enable the item conveyer 102 to operate to move items away from the container 406 as described below.

At the destination location 502, the container valve coupler 410 is coupled to the air supply 412 via the air supply valve coupler 414. After the coupling of the container valve coupler 410 to the air supply valve coupler 414, the air supply 412 may provide air to the bladder 402 to inflate the bladder 402 and thereby raise the support platform 404 to predetermined location 416.

Figure 5C:
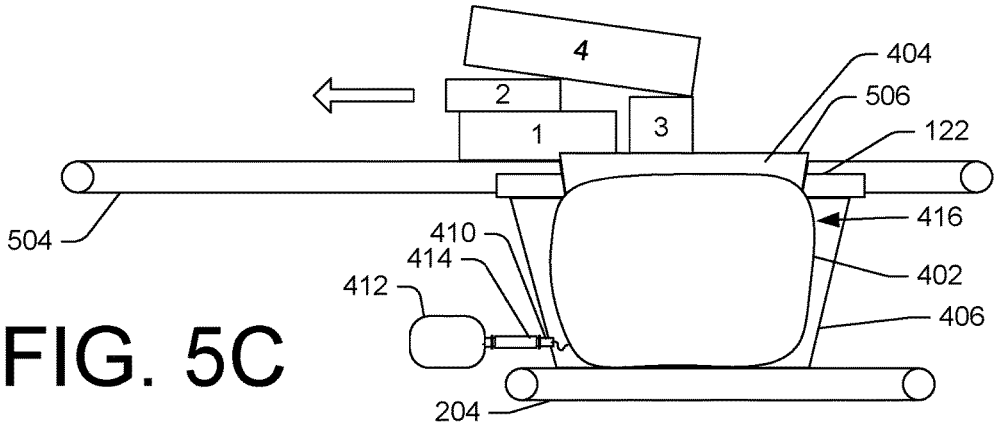

FIG. 5C shows the items of the container 406 being unloaded onto the receiving conveyer 504. To unload the items, the air supply 412 may cause the bladder 402 to be inflated and additionally raise the support platform 404 to an emptying location 506, which may be even with or higher than the container upper surface 122. As the support platform 404 approaches the emptying location 506, the support platform 404 may be tilted toward the receiving conveyer 504. The tilting of the support platform 404 may be caused by a shape of the bladder 402 (e.g., curved or triangular shape at top of the bladder, etc.), features in guides that guide the support platform 404 to cause a tilt (e.g., a guide may restrict one side of the support platform 404 to cause tilting when the support platform 404 is near the top of the container 406), and/or other features. The guides may constrain at least one of movement or orientation of the support platform 404 as the support platform within the container. In some embodiments, the support platform 404 may include rollers or other features to reduce friction of items on the support platform 404 for depositing the items on the receiving conveyer 504. In various embodiments, the support platform 404 may include one or more conveyers to direct items onto or off of the support platform 404. For example, a powered conveyer may be used to move items off the conveyer as discussed below during an unloading process. In various embodiments, the items may be removed from the support platform 404 by vibrating or shaking the container 406 and/or support platform 404.

Figure 5D:
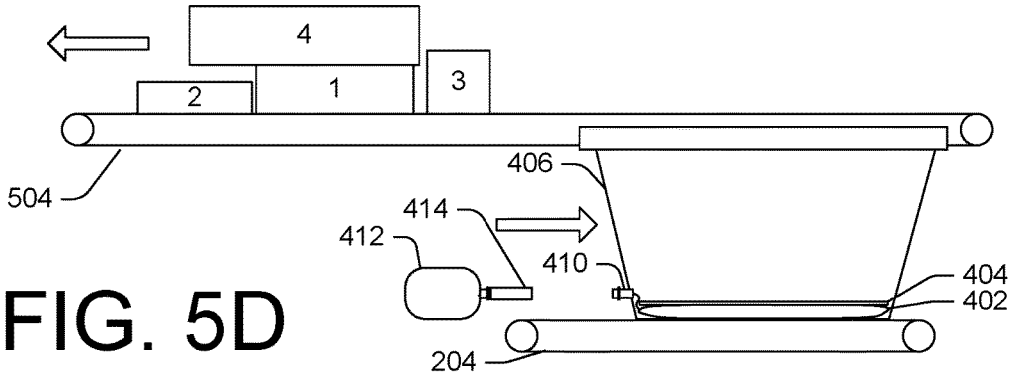

FIG. 5D shows the container 406 being empty after moving away, via the container conveyer 204, from the delivery location 502. When present, the trigger switch may be deactivated when the container is moved away from at the filling location 408, which may cause the receiving conveyer 504 to stop moving. The container valve coupler 410 is decoupled from the air supply valve coupler 414, and thus from the air supply 412. After the decoupling, the bladder 402 may deflate more. In some embodiments, the container valve coupler 410 may include a dust cover to prevent dust or other particulates from entering the bladder 402 during handling of the container 406. The dust cover may open during the coupling of the container valve coupler 410 to the air supply valve coupler 414 to allow airflow through the container valve coupler 410. In some embodiments, rather than moving the container 406, it may be loaded with items at the destination location.

Figure 6A:
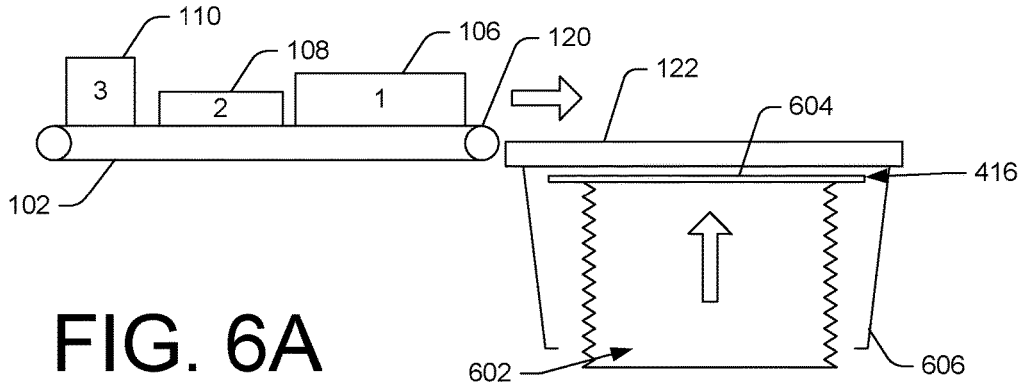
FIGS. 6A-6C show schematic diagrams of an illustrative container base height adjustment apparatus that selectively changes the height of a base of a container during filling of the container with items.
Figure 6B:
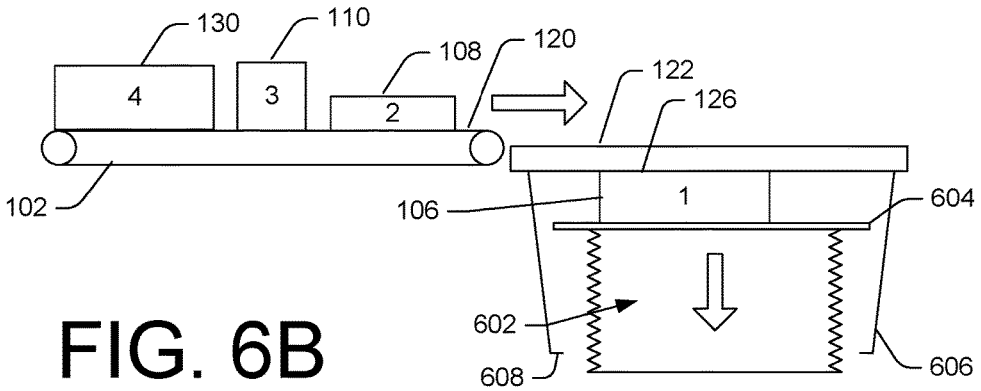
Figure 6C:
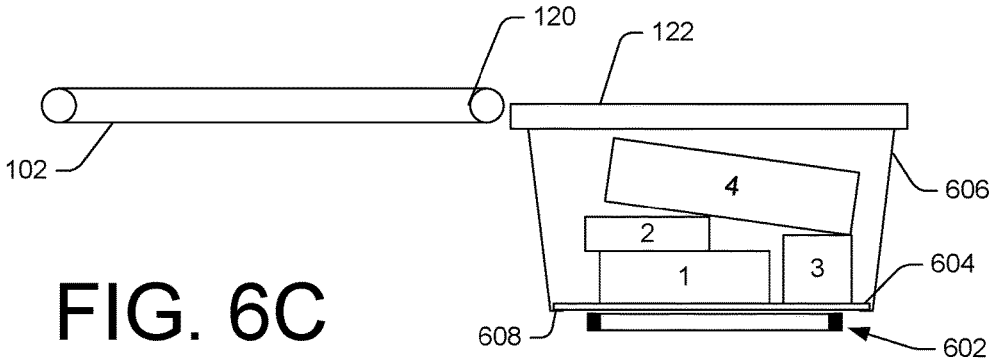

FIGS. 6A-6C show schematic diagrams of an illustrative container support platform height adjustment apparatus 602 (also referred to herein as the platform movement mechanism 402) that selectively changes the height of a support platform 604 of a container 606 during filling of the container 606 with items. The container support platform height adjustment apparatus 602 may operate similar to the bladder 114 described with reference to FIGS. 1A-1C, but may differ in at least two ways. Firstly, the support platform 604 of the container 606 may be detachable from a bottom position of the container, to enable the support platform 604 to raise relative to the container 606 (similar to the raising of the support platform 404 described above). Secondly, the container support platform height adjustment apparatus 602 may be moved by means other than inflation/deflation of a bladder.

FIG. 6A shows the container 606 and the container support platform height adjustment apparatus 602 prepared for receipt of items, but before items are placed in the container 606 by the item conveyer 102. As shown, the conveyer upper surface 120 of the item conveyer 102 is situated slightly above a container upper surface 122 of the container 104 to enable items to fall from the item conveyer 102 into the container 606. Meanwhile, the support platform 604 is situated by the container support platform height adjustment apparatus 602 just below the container upper surface 122 to minimize the fall of the first item 106 entering the container 606 from the item conveyer 102. The location of the support platform 604 is controllable based on movement caused by the container support platform height adjustment apparatus 602. For example, the container support platform height adjustment apparatus 602 may be moved by pneumatic pressure, by a biasing force, by a mechanical mechanism, by inflation of a bladder, and/or by other techniques or devices. Various devices and controls that create container support platform height adjustment apparatus 602 are discussed with reference to FIGS. 7A-7D.

FIG. 6B shows the first item 106 deposited into the container 606 and supported by the support platform 604 such that an upmost item upper surface 126 is below the container upper surface 122. Meanwhile, the support platform 604 has been lowered by the container support platform height adjustment apparatus 602 to a position closer to a base 608 of the container 606. Meanwhile a fourth item 130 may enter the item conveyer 102 for eventual deposit into the container 606. The base 608 may include one or more apertures. The container support platform height adjustment apparatus 602 may access the support platform via the one or more apertures, and possibly through the one or more apertures. The support platform may cover the one or more apertures during transport of the container.

FIG. 6C shows all of the items deposited into the container 606. The container support platform height adjustment apparatus 602 is lowered such that the container support platform height adjustment apparatus 602 disengages with the support platform 604. However, as described below, the container support platform height adjustment apparatus 602 may not engage the support platform in some embodiments even when the support platform 604 is in the raised position shown in FIG. 6A. The support platform 604 may couple to the base 608 of the container 606. In some embodiments, the base 608 of the container 606 may include a releasable coupler that may secure the support platform 604 to the container 606 (e.g., during transport of the container, etc.) until the releasable coupler is opened (disengaged), possibly by engagement by the container support platform height adjustment apparatus 602 during lifting of the support platform 604. In the position shown in FIG. 6C, the upmost item is the fourth item 130. The support platform 604 is lowered to a position closer to or proximate to the base 608 of the container 606. The container 606 may be ready for shipment, and may include at least the four items in this example and the support platform 604. However, the container support platform height adjustment apparatus 602 may not be shipped with the container, but may instead be available for use with a different container. Thus, the container 606 may be moved away from the filling location and away from (e.g., over) the container support platform height adjustment apparatus 602, such as when the container support platform height adjustment apparatus 602 is in a retracted position and disengaged from the support platform 604. As items are placed, or "fall" into the container, the distance of the fall of each item is less than a fall would be if the support platform 604 were not moved by the container support platform height adjustment apparatus 602. This reduction in distance due to movement of the support platform 604 may prevent or minimize damage to items caused by the fall of the items into the container from the conveyer upper surface 120 toward the base 608 of the container 606. The embodiments described with reference to FIGS. 6A-6C may be used with any of the prior embodiments described, such as the embodiments described with reference to FIGS. 3A-3C.

FIGS. 7A-7D show schematic diagrams of various illustrative container support platform height adjustment apparatuses that selectively change the height of the support platform 604 of the container 606.

Figure 7A:
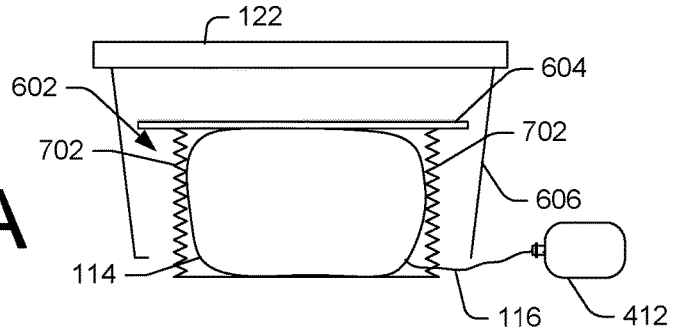
FIGS. 7A-7D show schematic diagrams of various illustrative container base height adjustment apparatuses that selectively changes the height of the base of the container.

FIG. 7A shows the container support platform height adjustment apparatus 602 (also referred to herein as the platform movement mechanism 402) implemented with the bladder 114 that is inflated by the air source 412 via the hose 116. The bladder 114, when inflated, may push the support platform 604 away from the base 608 of the container 606 and toward the container upper surface 122. The bladder 114 may be inflated and deflated as described in the embodiments above to control the location of the support platform 604, and thus, the upmost item upper surface (as described with reference to FIG. 1B). The container support platform height adjustment apparatus 602 may include guides 702, which may create an attachment point for the support platform 604 and/or control movement of support platform 604 along an axis while moving inside of the container 606. In some embodiments, the guides 702 may compact using an accordion-like design. However, other designs may be used to create the guides 702.

Figure 7B:
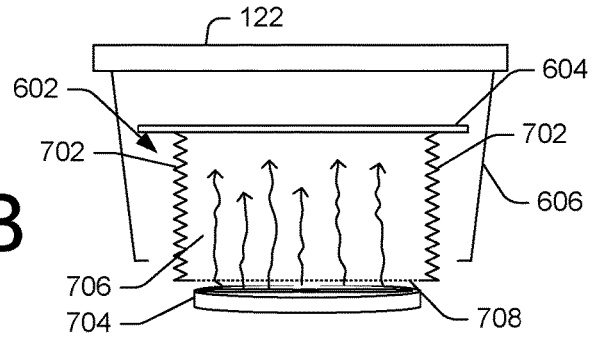

FIG. 7B shows the container support platform height adjustment apparatus 602 implemented with an air power source 704, such as a fan or a pneumatic power source that directs air into a cavity of the container support platform height adjustment apparatus 602. The air power source 704 may include fluid communication of air into the cavity 706 to cause the support platform to move up or expand (as a result of increased airflow into the cavity 706), and to move down (after reducing or terminating airflow into the cavity 706). The air from the air power source 704 may move through orifices 708 in a bottom of the container support platform height adjustment apparatus 602 to gain access to the cavity 706.

Figure 7C:
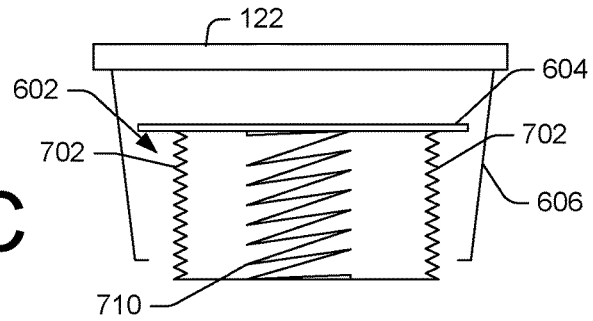

FIG. 7C shows the container support platform height adjustment apparatus 602 implemented with a biasing device 708, such as a spring that applies a force against the support platform 604 to bias the support platform 604 toward the container upper surface 122, but is compressed by a downward force applied by items placed on the support platform 604. The biasing device 710 may be locked in a compressed state or positioned under the container 606 when the container 606 is full and ready for movement away from the container support platform height adjustment apparatus 602.

Figure 7D:
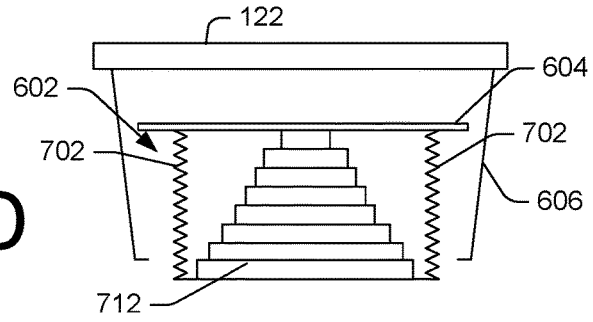

FIG. 7D shows the container support platform height adjustment apparatus 602 implemented with a mechanical device 712, such as a telescoping device or mechanical arm that may be controlled by actuation of solenoids, motors, and/or other devices to move the support platform 604 toward the container upper surface 122 or away from the container upper surface 122.

FIGS. 8A-8D show schematic diagrams of an illustrative sortation apparatus 802 that causes a heavier item to be deposited in a container before a lighter item. By depositing heavier items before some lighter items, items are less likely to be damaged during the loading of items into a container. The embodiments of the sortation apparatus 802 described below may be implemented with any of the embodiments described that limit a distance items drop into the container. However, the embodiments of the sortation apparatus 802 described below may also be implemented independent from embodiments described that limit a distance items drop into the container.

Figure 8A:
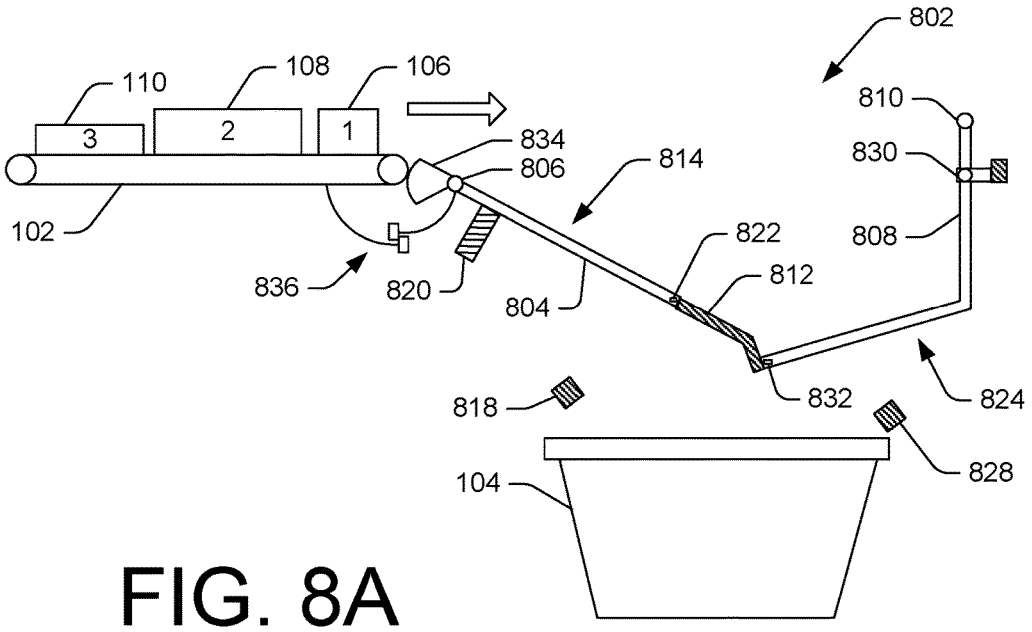
FIGS. 8A-8D show schematic diagrams of an illustrative sortation apparatus that causes a heavier item to be deposited in a container before a lighter item.

FIG. 8A shows the sortation apparatus 802 before receipt of items provided by the item conveyer 102. The container 104 may be situated underneath and proximate to the sortation apparatus 802. The container 104 may be empty or otherwise ready for receipt of items.

The sortation apparatus 802 may include a first member 804 that moves about a first pivot 806 and a second member 808 that moves about a second pivot 810. For example, the members may move by rotation, by bending (deflection), or by other means generally about a pivot. The movement of the members 804 and 808 may be caused in response to a weight of an item supported by a member where the item imparts a force on the respective member. However, the movement may be caused by other devices or techniques, such by actuation by a device (e.g., an actuator, a solenoid, etc.).

In some embodiments, a structure 812 may be included and situated between the first member 804 and the second member 808. The structure 812 may be not be movable (e.g., rotatable with the first member 804 or second member 808, etc.), and thus may function to guide items from the first member 804 to the second member 808 and/or may retain items on the second member 808 while the first member 804 empties another item into the container 104.

As items are conveyed from the item conveyer 102 onto the sortation apparatus 802, the items may begin to travel (slide, roll, etc.) down a top surface of the first member 804 toward the second member 808. The first member 804 may be designed to selectively move about the first pivot 806 to cause an item that exceeds a predetermined weight to enter the container 104, as shown in FIG. 8B.

Figure 8B:
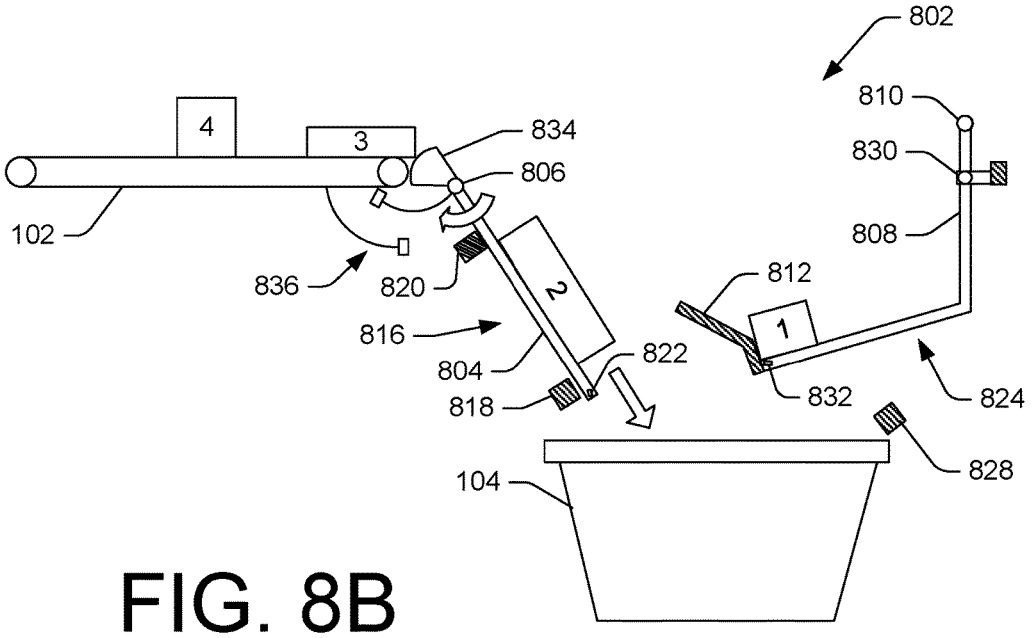
Figure 8C:
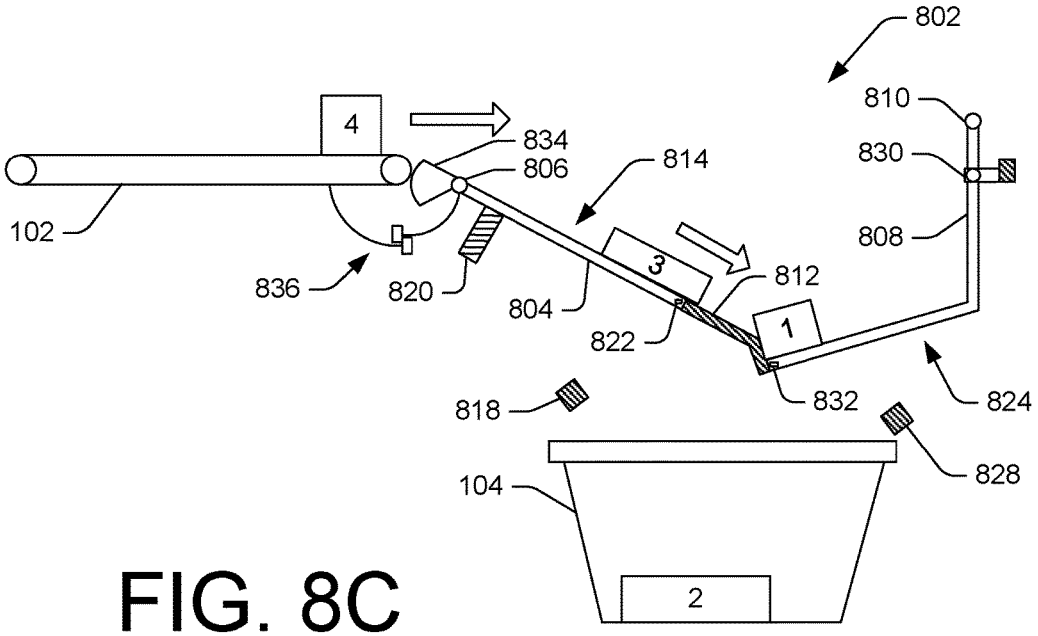

The first member 804 may move from a first position 814 shown in FIG. 8A to a second position 816 shown in FIG. 8B, such as when the first member 804 is subject to a force (weight) of an item that overcomes the predetermined weight. The movement of the first member 804 may be restricted by a first stopper 818. The first member 804 may be biased toward the first position 814 by a biasing device 820. The biasing device 820 may be selected to maintain an upward force equal to the predetermined weight, or to simply return the first member 804 to the first position 814 whereas another device may be used to regulate when the first member 804 moves or is able to move to the second position 816. In some embodiments, a first inhibitor 822 may be used to maintain the first member 804 in the first position 814 until the predetermine weight (or force) is exceeded. For example, the first inhibitor 822 may be a magnet or an electromagnet, located near or at an end of the first member 804 proximate to the structure 812, may be used to maintain the first member 814 in the first position until a force imparted on the first member by an item overcomes the attraction force of the magnets, and thereby allows the first member 804 to move about the first pivot 806 and deposit the item in the container 104. In some embodiments, the predetermined weight, that when reached or exceeded, enables an item to be deposited into the container via movement of the first member 804 may be adjusted, such as by adjusting a staying power/force of the first inhibitor 822 and/or adding or removing biasing devices/forces via the biasing device 820. For example, the predetermine weight may be modified based on the known or expected weight of items to be loaded in the container, such as from information contained in a packing list.

Figure 8D:
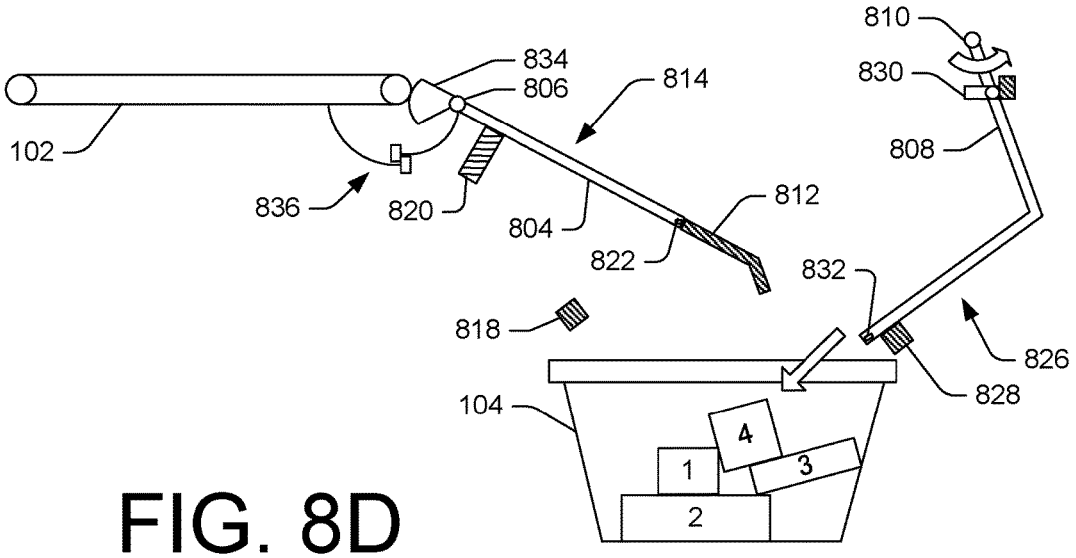

When an item does not cause the first member 804 to move about the first pivot 806, such as a relatively light item, the item may continue to travel (slide, roll, etc.) onto the second member 808. The item may come to rest at a location supported by the second member 808. At a predetermined time, or other time, the second member 808 may move about the second pivot 810 from a first position 824 shown in FIG. 8C to a second position 826 shown in FIG. 8D, causing lighter items to be deposited in the container 104 possibly on top of heavier items previously deposited into the container 104. The movement of the second member 808 may be restricted by a second stopper 828. The second member 808 may be controllably moved by a mechanism 830 between the first and second positions or from the first position 824 to the second position 826. The mechanism 830 may be an actuator, a biasing device, a solenoid, and/or other similar devices that cause movement of the second member 808. For example, the second member 808 may be biased in the first position 824 by a biasing device that imparts enough force against the second member 808 to maintain the second member 808 in the first location 824, but not enough force to support the second member 808 loaded with any item on top of the second member 808 that exerts a force on the second member 808. Thus, the biasing device may be used to return the second member 808 from the second position 826 to the first position 824 when the second member 808 is not subject to other forces, such as a force resulting from weight of an item on top of the second member 808. A second inhibitor 832, such as an electromagnet, located near or at an end of the second member 808 proximate to the structure 812, may be to selectively maintain the second member 808 in the first position 824 from emptying items into the contain 104 until desired, such as when all of the heavy items have been deposited into the container 104 and/or when the container is ready to be removed for shipping purposes or other purposes. For example, the second inhibitor 832 be operate as a switch, which when triggered or activated (e.g., electromagnet turned off, etc.), allows the second member 808 to move to the second position 826 to deposit items into the container 104 as shown in FIG. 8D. As another example, movement of the container may trigger activation of the second inhibitor 832 to release the second member 808 to move to the second position 826 to deposit items into the container 104.

Returning to FIG. 8A, the first member 804 may be coupled to one or more devices that prevent subsequently conveyed items (e.g., following items) from being deposited into the container 104 with another item that overcomes the predetermined weight (force) that moves the first member 804 to the second position 816. A blocking structure 834 may block the subsequently conveyed item from moving along the first member 804 when the first member is at the second position 816 or between the second position 816 and the first position 814 (as shown in FIG. 8B). For example, the blocking structure 834 may be move upwards and be exposed above the item conveyer 102 when the first member 804 moves toward the second position 816, thereby preventing the subsequently conveyed item from entering the first member 804 until the first member 804 returns to the first position 814.

In some embodiments, a switch 836 may be situated between the item conveyer 102 and the first member 804. The switch 836 may, when disengaged (open), may cause the item conveyer 102 to stop, at least temporarily. The switch 836 may be opened by movement of the first member 804 from the first position 814 to the second position 816. Thus, when the switch 836 is present, the item conveyer 102 may move items when the first member 804 is in the first position 814, but not when the first member 804 is in the second position 816 or possibly not when the first member 804 is between the first position 814 and the second position 816.

Figure 9:
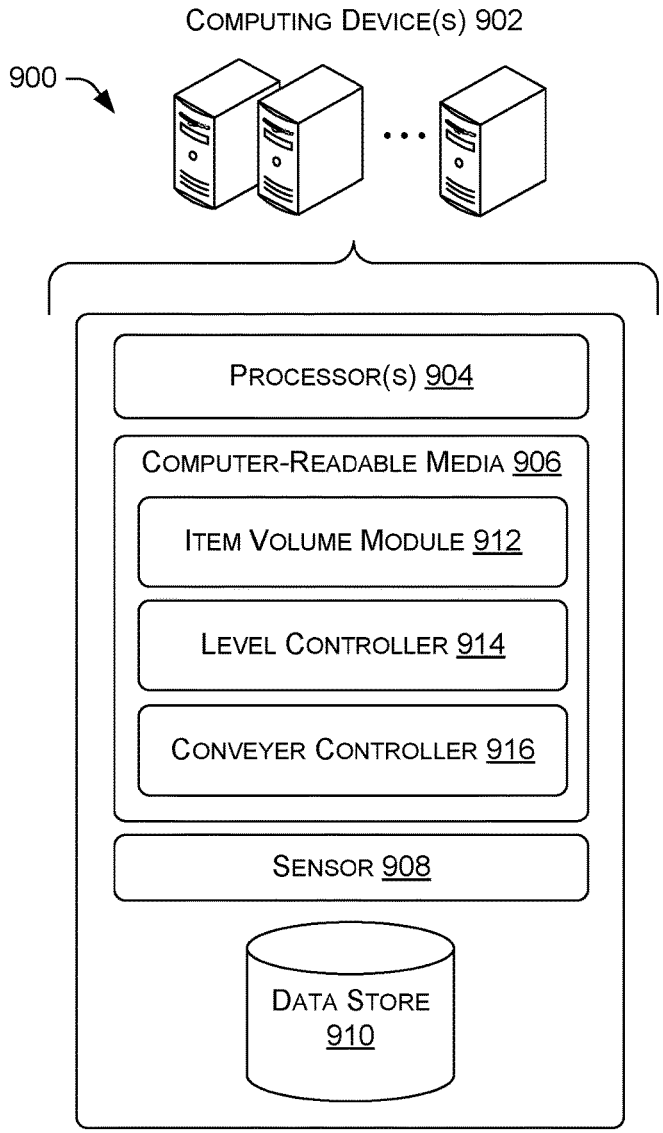
FIG. 9 is a schematic diagram of an illustrative computing architecture to control at least some of the item sortation and protection apparatuses disclosed herein.

FIG. 9 is a schematic diagram of an illustrative computing architecture 900 to control at least some of the item sortation and protection apparatuses disclosed herein. The computing architecture 900 may be implemented in a distributed or non-distributed computing environment by computing device(s) 902

The computing architecture 900 may include one or more processors 904 and one or more computer readable media 906 that stores various modules, applications, programs, or other data. The computer-readable media 906 may include instructions that, when executed by the one or more processors 904, cause the processors to perform at least some of the operations described herein.

Embodiments may be provided as a computer program product including a non-transitory machine-readable storage medium having stored thereon instructions (in compressed or uncompressed form) that may be used to program a computer (or other electronic apparatus) to perform processes or methods described herein. The machine-readable storage medium may include, but is not limited to, hard drives, floppy diskettes, optical disks, CD-ROMs, DVDs, read-only memories (ROMs), random access memories (RAMs), EPROMs, EEPROMs, flash memory, magnetic or optical cards, solid-state memory apparatuses, or other types of media/machine-readable medium suitable for storing electronic instructions. Further, embodiments may also be provided as a computer program product including a transitory machine-readable signal (in compressed or uncompressed form). Examples of machine-readable signals, whether modulated using a carrier or not, include, but are not limited to, signals that a computer system or machine hosting or running a computer program can be configured to access, including signals downloaded through the Internet or other networks.

The computing architecture 900 may include one or more sensors 908 and/or interfaces to communicate with sensors and a data store 910, which may store item information, such as an item identifier associated with physical properties of items, and so forth. The sensors 908 may include the optical sensor 302, the image sensor 308, and/or other sensors described herein or usable to assist the operations described herein.

In some embodiments, the computer-readable media 906 may store an item volume module 912, a container level controller 914, and a conveyer controller 916, each described in turn. The components may be stored together or in a distributed arrangement.

The item volume module 912 may calculate a volume of an item using information retrieved from the data store 910. For example, an item may be scanned or otherwise imaged by the image sensor 308 to obtain an item identifier. The item identifier may be used to retrieve physical property information about the item from the data store 910, which may be used by the item volume module 912 to determine a volume or other information (e.g., height, weight, fragility, etc.) about the item to influence inflation of the bladder 114 and/or movement of the support platform 404 or base 604 as discussed above.

The level controller 914 may control an inflation of the bladder 114 and/or movement of the support platform 404 or base 604 as discussed above based on input from the item volume module and/or from other inputs, such as from signals from the optical sensor 302.

The conveyer controller 916 may control conveyance of the item conveyer 102, the container conveyer 204, and/or the receiving conveyer 504. For example, the conveyer controller 916 may stop the item conveyer 102 when items in the container rise above the container upper surface 122 as detected by the optical sensor 302, among other possible controls of the conveyers described herein.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. An automated container packing system comprising:

a container to be filled with items at a first location for transport to a second location, the container having a rim that includes an opening to enable depositing of items into the container, the container including a support platform configured to receive items deposited into the container;

an item conveyer to move the items to the first location and deposit the items into the container, the item conveyer having a conveyance height that is above the rim of the container;

a platform movement mechanism at the first location coupled to the support platform, the platform movement mechanism to move the support platform relative to a base of the container, the platform movement mechanism to position the support platform in a first position proximate to the rim of the container to receive a first item, and to position the support platform in a second position lower than the first position causing an upper surface of the first item to be proximate to the rim of the container in preparation to receive a second item in the container; and an optical sensor in communication with the platform movement mechanism, the optical sensor directed across a plane defined by the rim of the container, the platform movement mechanism causing the support platform to move from the first position toward the second position in response to detection of a signal from the optical sensor that indicates that the plane is intersected by the first item.

2. The automated container packing system as recited in claim 1, wherein the support platform forms a bottom side of the container when the platform movement mechanism is retracted underneath and away from the container.

3. The automated container packing system as recited in claim 2, wherein the support platform includes a releasable coupler that secures the support platform in a transport position at the bottom side of the container, and the platform movement mechanism configured to disengage the releasable coupler before or during lifting of the support platform.

4. The automated container packing system as recited in claim 1, wherein the platform movement mechanism is further configured to, at the second location:

raise the support platform toward the rim of the container while items are supported by the support platform; and tilt the support platform to cause the items to move off of the support platform and out of the container.

5. The automated container packing system as recited in claim 1, wherein the platform movement mechanism is located within the container.

6. The automated container packing system as recited in claim 1, further comprising at least one guide within the container to guide movement of the support platform as the support platform traverses between the first location and the second location.

7. An apparatus, comprising:

a support platform configured to receive items deposited into a container from a conveyer; and a platform movement mechanism to cause selective movement of the support platform, the platform movement mechanism to move the support platform relative to a base of the container, the platform movement mechanism to position the support platform in a first position proximate to a top of the container to receive a first item, and to position the support platform in a second position lower than the first position causing an upper surface of the first item to be proximate to the top of the container in preparation to receive a second item in the container.

8. The apparatus as recited in claim 7, wherein the platform movement mechanism is an inflatable bladder.

9. The apparatus as recited in claim 8, further comprising the container that includes a container valve coupler in fluid connection with the inflatable bladder, the container valve coupler to mate with an air supply valve coupler in fluid connection with an air supply regulated by an air supply controller.

10. The apparatus as recited in claim 7, wherein the support platform forms a bottom side of the container when the platform movement mechanism is retracted underneath and away from the container.

11. The apparatus as recited in claim 7, wherein the platform movement mechanism includes a biasing device.

12. The apparatus as recited in claim 7, wherein the items are received at a first location, and wherein the platform movement mechanism is further configured to empty items from the container at a second location by extending the support platform at least to the top of the container.

13. The apparatus as recited in claim 12, further comprising a guide to cause the support platform to tilt relative to the base of the container during or before emptying the items from the container.

14. The apparatus as recited in claim 7, wherein the platform movement mechanism includes a fan that directs air into a cavity formed by the support platform and causes movement of the support platform.

15. The apparatus as recited in claim 7, further comprising an optical sensor in communication with the platform movement mechanism, the optical sensor directed across a plane defined by the top of the container, the platform movement mechanism causing the support platform to lower toward the base in response to detection of a signal from the optical sensor that indicates that the first item interferes with the plane.

16. A packaging system comprising:

a container having a base and a plurality of sides that extend from the base to form a cavity, the cavity including a rim that includes an opening to enable depositing of items into the container, the container further including a support platform configured to receive items deposited into the container;

an item conveyer to deposit the items into the container, the item conveyer having a conveyance height that is even with or above the rim of the container; and a platform movement mechanism configured to cause movement of the support platform, the platform movement mechanism to move the support platform relative to the base of the container, the platform movement mechanism to position the support platform in a first position proximate to the rim of the container to receive a first item, and to position the support platform in a second position lower than the first position causing an upper surface of the first item to be proximate to the rim of the container in preparation to receive a second item in the container.

17. The packaging system as recited in claim 16, wherein the items are received at a first location, and wherein the platform movement mechanism is further configured to empty items from the container at a second location by extending the support platform at least to the top of the container.

18. The packaging system as recited in claim 16, wherein the container further including a guide that constrains at least one of movement or orientation of the support platform as the support platform is moved by the platform movement mechanism.

19. The packaging system as recited in claim 16, wherein the base includes at least one aperture, and wherein platform movement mechanism accesses the support platform via the at last one aperture, and the support platform covers the at least one aperture during transport of the container.

20. The packaging system as recited in claim 16, further comprising an sensor in communication with the platform movement mechanism, the sensor directed at least partially across a plane defined by the top of the container, the platform movement mechanism causing the support platform to lower toward the base in response to detection of a signal from the sensor that indicates that the first item interferes with the plane.

* * * * *